United States Patent [19]

Salmi et al.

[11] 4,028,995

[45] June 14, 1977

[54] HYDRAULIC STRIKING APPARATUS

[75] Inventors: Pekka Salmi; Pentti Raunio, both of Tampere, Finland

[73] Assignee: Oy Tampella AB, Finland

[22] Filed: Apr. 18, 1975

[21] Appl. No.: 569,531

[30] Foreign Application Priority Data

Apr. 25, 1974 Finland ..... 1267/74
Feb. 17, 1975 Finland ..... 750425

[52] U.S. Cl. ..... 91/276; 91/298; 91/300; 91/319; 91/321

[51] Int. Cl.[2] ..... F01B 7/18; F01L 25/04; F01L 17/00

[58] Field of Search ..... 91/297, 298, 27 C, 321, 91/300, 319

[56] References Cited

UNITED STATES PATENTS

| | | | |
|---|---|---|---|
| 707,920 | 8/1902 | Haeseler | 91/276 |
| 1,132,649 | 3/1915 | Brazelle | 91/27 C |
| 1,593,606 | 7/1926 | Slater | 91/27 C |
| 2,906,244 | 9/1959 | Christensen | 91/27 C |

*Primary Examiner*—Paul E. Maslousky
*Attorney, Agent, or Firm*—Roylance, Abrams, Berdo & Kaul

[57] ABSTRACT

An hydraulically operated striking apparatus for driving a rock drill or the like comprises a body having an axial, generally cylindrical, interior space with an inwardly protruding annular member. A cylindrical piston is positioned in the space in sliding contact with the protruding annular member, and the piston has canal means in its outer surface. The body, the annular member and the piston define two annular spaces and an annular distributing valve is slidably disposed within one of the spaces. The two spaces communicate with each other by means of the piston canal when the piston is in a first slidable position, and the protruding annular member prevents communication between the two spaces when the piston is in a second slidable position. The piston is provided with an axially disposed extension which, in combination with an outlet means, serves to permit a third, annular axial space to communicate with either an inlet means or an outlet means at all times.

7 Claims, 3 Drawing Figures

HYDRAULIC STRIKING APPARATUS

This invention relates to an hydraulically operated striking apparatus. More particularly, this invention relates to a striking apparatus operated by pressure liquid, preferably for a rock drill, the said striking apparatus comprising a body to which the tool can be movably attached, a striking piston moving to and fro in the cylinder space and a liner type distributing valve concentric with the piston, moving to and fro in the valve space and aimed for changing the direction of the motion of the piston.

Various liquid operated striking apparatuses have recently been built by different manufacturers due to the economy of pressure liquid compared with that of compressed air. The difficulties that have been experienced in striking apparatuses operated by pressure liquid have included the harmful effect of the wear of striking end of the piston on the operation of the striking apparatus, the starting difficulties, and the complexity of construction being caused by the location of the distributing valve. Another difficulty in such striking apparatuses is in obtaining the mutual synchronization of the movements of the piston and the distributing valve in the cases in which these movements conduct the outlet of the pressure liquid from the cylinder space into the outlet canal and the inlet of the pressure liquid into the said cylinder space.

The objects of this invention include the elimination of the aforesaid disadvantages and to provide a striking apparatus, the operation of which is not sensitive to the wear of the striking end of the piston, and which can be started in any position of the piston, which has the utmost simple construction, and is safe to run.

These and other objects are achieved with the hydraulically operated striking means of the present invention, which comprises: body means having an axial, generally cylindrical, interior space, said body means having an inwardly protruding annular member; cylindrical piston means axially slidable between a first position and a second position within the cylindrical space, the outer surface of said piston means being in sliding contact with the inner surface of said protruding annular member, said piston means having means defining canal means in the outer surface of said piston means; said body means, said annular member and said piston means defining a first annular space and a second annular valve space axially separated by said protruding annular member, said protruding annular member being adjacent said piston means; and annular distributing valve means slidably disposed in said second annular valve space and being axially slidable between a first position and a second position, said valve means and said annular member surrounding a portion of said piston means, said first annular space communicating with said second annular valve space by means of said canal means when the piston means is in said first slidable position, said annular member preventing communication between said spaces when said piston means is in said second slidable position.

The distributing valve has a first and a second end, the surface area of the first end being greater than the surface area of the said second end. The body means includes inlet means and outlet means with the inlet means continuously communicating with the second end. The first space continuously communicates with the inlet means, and the piston means, the valve means and the body means define a generally annular third space which communicates with the inlet means when the valve means is in its first slidable position, the valve means having a first valve outlet means and the body means having a first body outlet means. The third space communicates with the first valve outlet means and the first body outlet means when the valve means is in its second slidable position.

The valve means has a second valve outlet means and the body means has a second body outlet means. The second annular valve space communicates with the second valve outlet means and the second body outlet means by means of the canal means when the piston means is substantially in its second slidable position and the valve means is substantially in its second slidable position. The piston means is provided with an axially disposed extension, such extension being a second piston means surrounded by said third space and the body means, the third space communicating with the inlet means by means of a third body outlet means in the body means adjacent the second piston means. The third space communicates with the first valve outlet means and the first body outlet means when the second piston means prevents the third space from communicating with the inlet means. The distance between the piston means and the second piston means is greater than the distance between the first valve outlet means and the third body outlet means.

In this application, the terms "downs", "under" and "lower" means that end of the apparatus of which the tool is attached and "up", "above" and "upper", the opposite end of the apparatus. Also, the word "canal" is used in singular, even if the reference is made to a net of canals consisting of several canals.

Thus, the striking apparatus of the present invention involves a linear type distributing valve which changes the direction of the motion of the piston and is placed immediately around the cylinder space in the body of the apparatus so that the inner surface of the distributing valve forms a part of the cylindrical wall of the cylinder space opposite to the flange of the piston. The upper side of the distributing valve is continuously connected with the inlet canal of the pressure liquid, whereas the connection between the lower side of the distributing valve and the inlet canal of the pressure liquid is discontinuous. This discontinuity is accomplished so that when the piston is in its lowest position or near to it, the canals built into the flange of the piston connect under pressure the cylinder space below the flange of the piston with that part of the distributing valve space which is below the distributing valve. When the piston is in its upper position or near to it, the flange of the piston cuts up the said connection with the aid of a neck or protruding body member, that is between the said cylinder space under pressure and the said distributing valve space.

The cylinder space below the flange of the piston, which may be termed "the lower space", is continuously connected with the inlet canal of the pressure liquid, and the space above the flange of the piston, which is termed "the upper space", is also connected with the inlet canal when the distributing valve is in the lower position. However, when the distributing valve is in the upper position, the upper space is connected with the outlet canal.

The return motion of the piston is slowed and stopped by conveying at a suitable stage of the return stroke the liquid displaced by the piston to the pressure side of the striking apparatus where it is stored in a pressure accumulator. The accomplished work slows and finally stops the return motion of the piston. The pressure liquid stored in the pressure accumulator can be made use of when the next cycle of the piston begins, and therefore, the apparatus of the present invention provides a saving in energy compared with constructions in which the return stroke is stopped by an hydraulic absorber where the stroke energy is transformed into heat, or by driving the piston against a stationary hindrance. When idling, the piston is stopped by an hydraulic absorber that is in connection with the lower space. Now the warm liquid of the absorber space is mixed with the colder liquid of the lower space whereby the liquid is prevented from becoming too hot.

The lower end of the flange in the extension of the piston opens the connection from the upper cylinder space to the inlet canal of the pressure liquid through the canal in the body a little before the upper end of the flange of the piston has cut up the connection from the upper space into the outlet canal. This gives the oil in the upper cylinder space a free outlet at all times.

Other objects and advantages of the present invention will become apparent upon viewing the accompanying drawings, in which.

Figure 1:
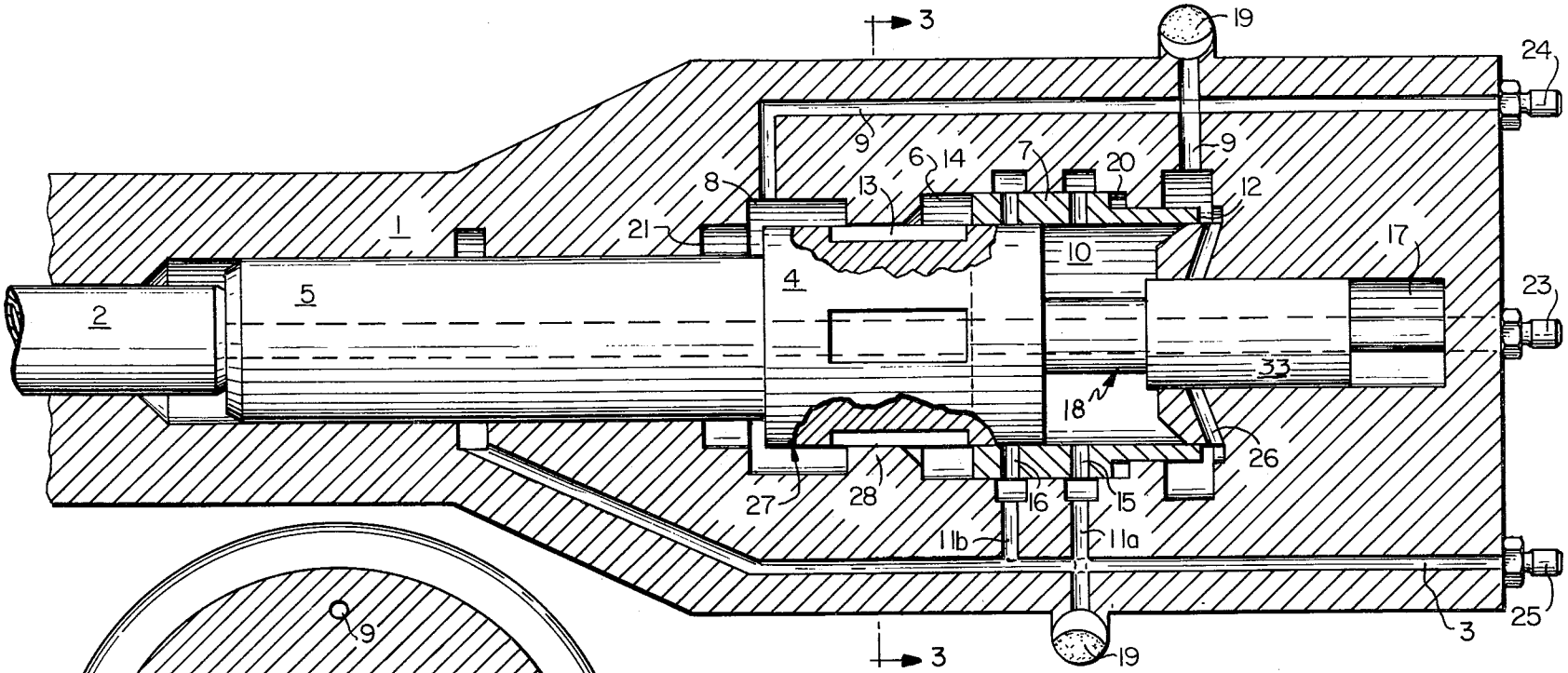
FIG. 1 is an elevational view of the striking apparatus of the present invention partly sectioned, showing the piston in its lowest position at the end of a work stroke.
Figure 2:
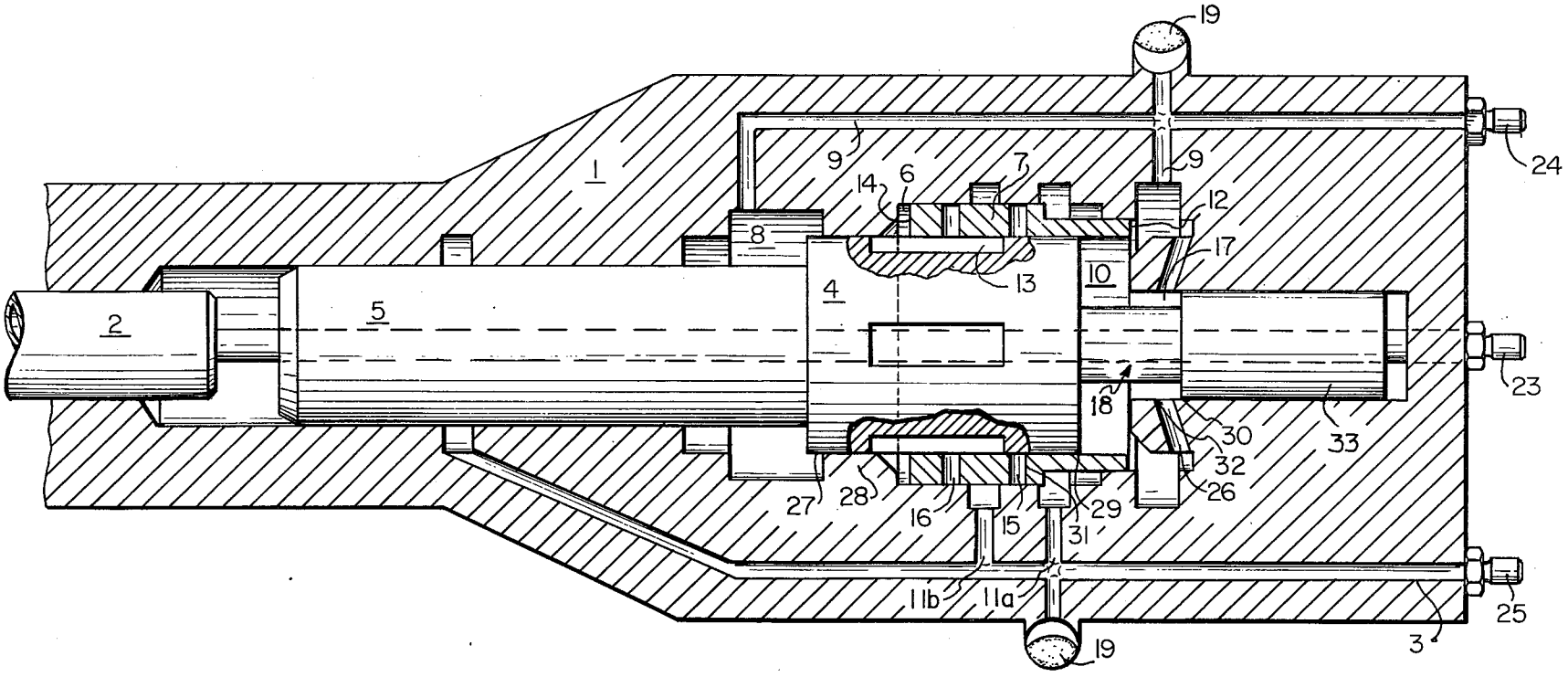
FIG. 2 is an elevational view of the striking apparatus of the present invention partly sectioned, showing the piston at the beginning of a work stroke.

Referring now to FIG. 1, the piston 27, the parts of which are a rod 5, a flange 4 and an extension 18, is in the cylinder space of the body 1 where it slidably moves to and fro. A cylinder space is present below the flange 4, which space is called the lower space 8 and the clyinder space above the flange 4 is called the upper space 10. At the upper end of the extension, there is a flange 33. While moving to and fro, the piston 27 strikes on the tool 2. If the tool 2 is not in place, the piston 27 stops in the absorber space 21 that is closed by the flange 4 when it is in its lowermost position, whereby the pressure in the absorber space rises high enough to stop the motion of the piston. As seen in FIG. 2, the space 17 for the flange 33 of the extension 18 connects the upper space 10 with the inlet canal 9 through the canal 26 when the piston 27 is coming close to its upper turning point. A flushing tube 23*a* leads from nipple 23 through the striking apparatus for conveying a flushing liquid, such as water, into the bore of the tool or drill steel. For this purpose, a water hose may be attached to nipple 23. The pressure pipe conveying the pressure liquid into the apparatus can be connected to the nipple 24, and correspondingly, the outlet pipe to the nipple 25. From the nipple 24 in the body of the apparatus begins the inlet canal 9 that leads to the lower space 8, the upper space 10 and the pressure accumulator 19. The flows of the liquid and the changes in pressure are balanced by the accumulator 19.

The inlet canal 9 is connected with the lower space 8 and through the distributing valve with the upper space 10. Differences in diameter of the piston 27 are such that the lower surface of the flange that is continuously under pressure is smaller than the upper surface, the pressure against which is either cut off or opened by the distributing valve 7 and the extension 18 of the piston. When the upper space 10 is under pressure, the piston 27 moves down. Correspondingly, when the upper space 10 is connected to the outlet canal 3, the piston moves up.

The liner type distributing valve 7 moves in the space 6 which is in the body 1 immediately around the part of the cylinder space 8 and 10 in which the flange 4 of the piston moves. Between the lower space 8 and the distributing valve space 6 there is a radially inwardly protruding body member or neck 28, the cylindrical inner surface of which forms part of the cylindrical wall of the cylinder space 8 and 10 around the flange of the piston.

Figure 3:
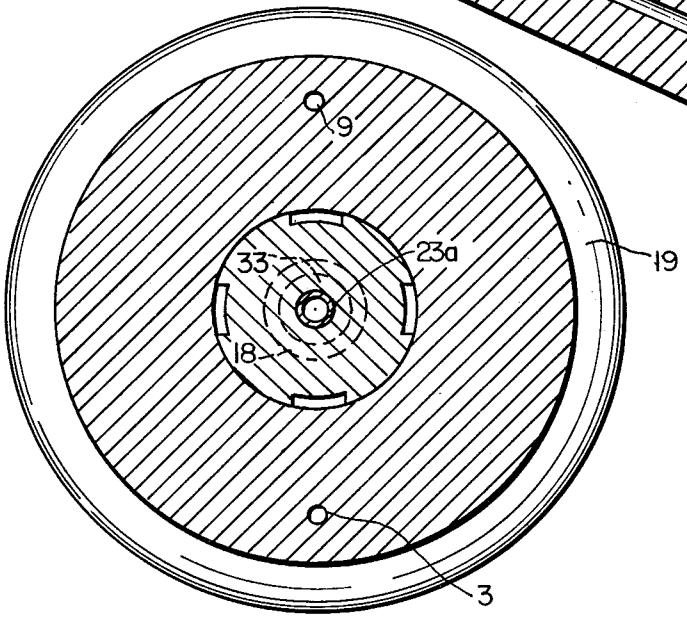
FIG. 3 is a sectional view of the apparatus taken along line 3—3 of FIG. 1 and looking in the direction of the arrows.

The part of the space 6 that is below the distributing valve 7 is connected with the lower space 8 by the canals 13 in the piston when the piston 27 has moved down enough. In the distributing valve 7 there are also openings 15 and 16 that are opposite to the outlet canals 11*a*, and 11*b* from time to time. When the distributing valve 7 is high enough, as in FIG. 1, the liquid can flow from the upper space 10 through the opening 15 in the distributing valve 7 into the outlet canal 11*a*. The sizes of the upper and lower ends 12 and 14 of the distributing valve 7 are such that when the distributing valve space 6 in the lower end of the distributing valve 7 is connected through the canals 13 with the lower space 8 under pressure, the force caused by the pressure against the lower surface 14 of the distributing valve 7 makes this move up. The reason for this is that the upper surface 12 of the distributing valve is smaller than the lower surface 14 and the pressure against both surfaces is the same. When the piston 27 has moved almost to its upper turning point while the distributing valve 7 is in its upper position, the canals 13, which are shown in cross-section in FIG. 3, in the flange 4 connect the distributing valve space 6 through the openings 16 in the distributing valve 7 with the outlet canal 11*b*. Before this the flange 4 has closed the connection between the lower space 8 and the distributing valve space 6 with the aid of the neck 28 in the body 1, which neck is located between the lower space 8 and the distributing valve space 6. When the distributing valve space 6 is connected with the outlet canal 11*b*, the pressure in the distributing valve space 6 decreases and the inlet pressure towards the upper surface 12 of the distributing valve 7 makes the distributing valve 7 move down.

FIG. 1 presents a situation where the piston 27 has just struck and is now starting its return movement. The distributing valve 7 is in its uppermost position stopped by the absorber 20. The pressure from the inlet canal 9 into the upper space 10 is completely closed and the escape through the hole 15 into the outlet canal 11*a* is open. The pressure in the lower space 8 forces the piston 27 to move up. The distributing valve space 6 is connected with the lower space 8 by the canals 13 in the piston 27.

After the piston has struck tool 2, its return movement begins. The return movement of the piston is at first accelerated while the liquid of the upper space 10 escapes through the canal 11*a* into the outlet canal 3. The acceleration decreases and finally the movement of the piston starts to slow down while the upper end 29 of the flange of the piston starts to choke the flow into the outlet canal 11*a*, whereby the pressure in the upper space 10 starts to rise. In order to prevent it from rising far over the average pressure in the pressure network of the striking apparatus, the flange 33 of the extension 18 of the piston opens the connection 26 from the upper space 10 into the inlet canal 9 already a little before the flange of the piston has completely closed the connection into the canal 11*a*. The said connection into the inlet canal is opened when the lower end 30 of the flange 33 of the extension 18 of the piston 27 has passed the lower edge 32 of the canal 26 and the said connection to the canal 11*a* is closed when the upper end 29 of the flange 4 of the piston 27 reaches the upper edge 31 of the opening 15. When the canal 11*a* is closed, the outlet phase into the outlet canal 3 has come to the end and the speed of the movement of the piston decreases. The liquid displaced by the piston while it is moving flows through the canal 26 into inlet canal 9 and is stored in the accumulator 19. The dotted space in accumulator 19 is pressurized gas, below which is a membrane and below the membrane is the hydraulic liquid, i.e., oil. The purpose of the pressure accumulator is to equalize the pressure variations in the oil system and to make the operation of the drill smoother.

When the piston 27 is moving upwards, the oil must always have free outlet out of the upper space 10. Thus, when using the conventional piston construction, the distributing valve 7 should always start to move downwards a little before the opening 15 is closed while the valve is in it upper position. It is very difficult to syncronize these operations when the conventional piston construction is used. When using the extension 18 of the piston in the above manner, this difficulty is eliminated. Now the valve 7 can stand still when the flow from the upper space 10 through the canals 26 and 9 into the pressure accumulator 19 begins a little before the flow from the upper space 10 into the canal 11*a* ends.

In FIG. 2 the piston 27 is ready to start its down stroke. At first the upper space 10 is filled through the canal 26 and the space 17 of the extension of the piston and simultaneously through the circuler canal opened by the distributing valve 7. When the piston 27 has moved down enough, the lower end 30 of the flange 33 of the extension 18 of the piston closes the connection from the upper space 10 through the canal 26 into the inlet canal 9. The distributing valve 7 is stopped in its lower position by the absorber. When the piston 27 is moving down, it opens the connection between the lower space 8 into the distributing valve space 6 through the canals 13 slightly, before the piston 27 strikes at the tool 2. The pressure in the distributing valve space 6 rises and moves the distributing valve 7 up. The connection from the inlet canal 9 into the upper space 10 is closed and the opening 15 comes opposite to the outlet canal 11*a*. The distributing valve 7 is stopped by the absorber 20 in the position shown in FIG. 1.

When the distributing valve 7 is in its upper position, the distance between the upper end 29 of the flange 4 of the piston 27 and the lower end 30 of the flange 33 of the extension 18 of the piston is longer than the distance between the upper edge 31 of the outlet opening 15, which is in the distributing valve 7 outlet from the upper cylinder space 10, and the lower edge of the canal 26 leading from the space 17 of the extension of the piston 27 into the inlet canal 9 of the pressure liquid, whereby the connection from the upper cylinder space 10 through the said space 17 of the extension 18 and the said canal 26 into the inlet canal 9 of the pressure liquid opens before the flange 4 of the piston closes the opening 15 in the distributing valve 7, which leads into the outlet canal 11*a*.

The striking apparatus of the present invention offers many advantages. Thus, the striking apparatus is simple in design, which results in the least possible amount of moving and wearing parts. Also, the piston and the distributing valve are mutually conducted by each other, and the apparatus starts in any position of these parts, which makes unnecessary springs and other auxiliary components which have been necessary in the known techniques in order to improve the starting.

The neck in the body and canals in the flange of the piston are easy to dimension so that the wear of the striking and of the piston does not disturb the operation of the striking apparatus. The striking apparatus is unsensitive to the pressure changes of the pressure liquid. Due to the advantageous location of the distributing valve, the inlet canal of the pressure liquid into the upper space of the cylinder is the shortest possible. Accordingly, the pressure losses are the smallest possible. The movement of the distributing valve in both directions is limited by the liquid absorber. In this way the mechanical wear of the ends of the distributing valve is eliminated.

Moreover, the pressure in the upper space 10 can never rise high enough to be harmful for the operation of the apparatus. The distributing valve 7 can now start to move down also a little after the canal 11*a* is completely closed because the canal 26 is already sufficiently open.

At the beginning of a work stroke, the upper space 10 is filled through two canals: through the canal 26 and through the circular canal opened by the distributing valve 7. Therefore, the upper space 10 is filled quickly and pressure losses are small.

The striking apparatus keeps operating even if the distributing valve 7 would not open the canal into the upper space 10 until the work stroke has started, because the canal 26 is still open to the upper space 10. This kind of operation results in the considerable advantage that the distributing valve may open more slowly, whereby the rise of the pressure in the space 6 becoms more even, and strong pressure changes in the outlet canal 3 are eliminated. The operation of the apparatus becomes smoother and the efficiency improves. In the above situtation the movement of the distributing valve 7 can be slowed by choking the canal 16.

Although the invention has been described in considerable detail with particular reference to certain preferred embodiments thereof, variations and modifications can be effected within the spirit and scope of the invention as described hereinbefore, and as defined in the appended claims.

What is claimed is:

1. An hydraulically operated striking means, comprising:

body means having an axial, generally cylindrical, interior space, said body means having a radially inwardly protruding annular member;

cylindrical piston means axially slidable between a first position and a second position within said cylindrical space, said piston means having an annular flange, the outer cylindrical surface of the flange of said piston means being in sliding contact with the inner surface of said protruding annular member, said piston means having means defining canal means in the outer cylindrical surface of said piston means flange;

said body means, said annular member and said piston means flange defining a first annular space and a second annular valve space axially separated by said protruding annular member, said protruding annular member being adjacent said piston means; and annular distributing valve means slidably disposed in said second annular valve space and being axially slidable between a first position and a second position, said valve means and said annular member surrounding a portion of said piston means so that in all operating positions of said piston means said flange is in contact with the inner surfaces of said distributing valve means and said annular member, said first annular space communicating with said second annular valve space by means of said canal means when said piston means is in said first slidable position, said annular member and said flange preventing communicating between said spaces when said piston means is in said second slidable position.

2. The striking means of claim 1, wherein said distributing valve has a first end and a second end, the surface area of said first end being greater than the surface area of said second end.

3. The striking means of claim 2 wherein said body means includes inlet means and outlet means, said inlet means continuously communicating with said second end.

4. An hydraulically operated striking means, comprising:

body means having an axial, generally cylindrical, interior space, said body means having a radially inwardly protruding annular member;

cylindrical piston means axially slidable between a first position and a second position within said cylindrical space, said piston means having a flange, the outer surface of said flange of said piston means being continuously in sliding contact with the inner surface of said protruding annular member, said piston means having means defining canal means in the outer surface of said piston means flange;

said body means, said annular member and said piston means flange defining a first annular space and a second annular valve space axially separated by said protruding annular member, said protruding annular member being adjacent said piston means; and annular distributing valve means slidably disposed in said second annular valve space and being axially slidable between a first position and a second position, said valve means and said annular member surrounding a portion of said piston means, said distributing valve having a first end and a second end, the surface area of said first end being greater than the surface area of said second end;

said first annular space communicating with said second annular valve space by means of said canal means when said piston means is in said first slidable position, said annular member preventing communication between said spaces when said piston means is in said second slidable position, said body means further including inlet means and outlet means, said inlet means continuously communicating with said second end, said first space continuously communicating with said inlet means, and said piston means, said valve means and said body means defining a generally annular third space which communicates with said inlet means when said valve means is in its first slidable position, said valve means having a valve outlet means, said third space communicating with said valve outlet means and said body outlet means when said valve means and said piston means are in their second slidable positions.

5. The striking means of claim 1 wherein said valve means has a valve outlet means and said body means has a body outlet means, the portion of said second annular valve space between said valve means and said annular member communicating with said valve outlet means and said body outlet means by means of said canal means when said piston means is substantially in its second slidable position and said valve means is substantially in its second slidable position.

6. The striking means of claim 5 wherein said piston means is provided with an axially disposed extension, said extension being a second piston means a first portion of which is surrounded by said third space and said body means, said third space communicating with said inlet means by means of a third body outlet means in said body means adjacent said second piston means, said second piston means having a second portion movable to close said third body outlet means, and said third space communicating with said first valve outlet means and said first body outlet means when said second piston means prevents said third space from communicating with said inlet means.

7. The striking means of claim 6 wherein the distance between said piston means and said second portion of said second piston means is greater than the distance between said first valve outlet means and said third body outlet means.

* * * * *